US006880996B2

(12) United States Patent
Herbert

(10) Patent No.: US 6,880,996 B2
(45) Date of Patent: Apr. 19, 2005

(54) METHOD AND APPARATUS FOR PRINTING ON SMARTCARDS AND THE LIKE

(75) Inventor: Raymond John Herbert, Leigh-on-Sea (GB)

(73) Assignee: Neopost Limited, Romford (GB)

( * ) Notice: Subject to any disclaimer, the term of this patent is extended or adjusted under 35 U.S.C. 154(b) by 31 days.

(21) Appl. No.: 09/770,184

(22) Filed: Jan. 29, 2001

(65) Prior Publication Data

US 2002/0021931 A1 Feb. 21, 2002

(30) Foreign Application Priority Data

Jan. 29, 2000 (GB) ..... 0001978

(51) Int. Cl.[7] ..... B41J 13/12
(52) U.S. Cl. ..... 400/521; 400/580
(58) Field of Search ..... 400/521, 580, 400/582, 522, 622, 623

(56) References Cited

U.S. PATENT DOCUMENTS

| | | | | | |
|---|---|---|---|---|---|
| 4,790,475 | A | * | 12/1988 | Griffin | 229/69 |
| 4,813,799 | A | * | 3/1989 | Dickey | 400/522 |
| 4,966,477 | A | * | 10/1990 | Vitale | 400/622 |
| 5,087,238 | A | | 2/1992 | Olson | 493/379 |
| 5,602,977 | A | | 2/1997 | Lee | 395/117 |
| 6,062,752 | A | * | 5/2000 | Pierce et al. | 400/622 |
| 6,065,883 | A | * | 5/2000 | Herring et al. | 400/225 |
| 6,065,885 | A | * | 5/2000 | Bodapati et al. | 400/622 |
| 6,193,152 | B1 | * | 2/2001 | Fernando et al. | 235/380 |
| 6,341,274 | B1 | * | 1/2002 | Leon | 705/410 |

FOREIGN PATENT DOCUMENTS

| | | | | |
|---|---|---|---|---|
| DE | 29816418 | | 9/1998 | |
| EP | 0724234 | | 1/1996 | |
| EP | 0799710 | | 9/1996 | |
| EP | 1057651 | | 5/2000 | |
| GB | 1185648 | | 3/1970 | |
| JP | 0139745 | * | 6/1988 | 400/522 |
| WO | 87/02973 | | 5/1987 | |

OTHER PUBLICATIONS

International Search Report.

* cited by examiner

*Primary Examiner*—Anthony H. Nguyen
(74) *Attorney, Agent, or Firm*—Shoemaker and Mattare

(57) ABSTRACT

A method for printing on a smart card using the printer of a postage meter is disclosed. The postage meter has a feed mechanism for feeding mail items past a print head and the construction of the feed mechanism is such that the spacing of adjacent feed rollers is greater than the length of the smart card. As a result the feed mechanism is incapable of feeding smart cards. Therefore in the method a carrier is provided for the smart card, the carrier being of sufficient length as to be engaged by the feed rollers during feeding thereof. Preferably the carrier comprises a sheet having a recess therein to receive the smart card so that the print receiving surface of the smart card is approximately co-planar with the surface of the carrier sheet.

5 Claims, 2 Drawing Sheets

METHOD AND APPARATUS FOR PRINTING ON SMARTCARDS AND THE LIKE

BACKGROUND OF THE INVENTION

This invention relates to printing on so-called smartcards and similarly dimensioned articles and in particular to apparatus enabling a printing device of a postage meter to print an imprint on a smartcard or the like.

Potage meters include printing means for printing a postage indicium on a mail piece. The postage indicium provides evidence that accounting has been effected in respect of a postage charge to be applied to the mail piece. The printing means includes feed rollers operative to feed mail pieces along a feed bed to and past a print head of the printing means. In postage meters in which the printing means operates by thermal transfer printing, a pair of input feed rollers feed mail pieces to the print head and a driven impression roller mounted in opposition to the print head presses the mail piece into ink transfer engagement with a thermal transfer ink ribbon and the ink ribbon into heat transfer engagement with a thermal print head. In order to accommodate a cassette containing thermal transfer ribbon, the input rollers are spaced a significant distance from the impression roller in an upstream direction. This spacing of the input rollers from the impression roller is acceptable when printing on mail pieces which are much longer than this spacing of the rollers because the input rollers are able to feed the mail piece until at least the leading edge of the mail piece has been engaged by the impression roller and further feeding of the mail piece past the print head can be effected by the impression roller.

Smartcards may be utilised for input of information and data into postage meters and for example may be used to input data to enable the printing means of the postage meter to print a desired advertising slogon alongside the postal indicium on the mail piece. A desired advertising slogon may be designed on behalf of a postage meter user and data for controlling the printing means of the postage meter to print the desired slogon is written into an electronic memory of the smartcard and the smartcard is then provided to the user of the postage meter. A user of the postage meter may require a number of different advertising slogons for use at different times and hence it is desirable that the smartcards in which the different slogons are recorded may be easily identifiable. For this reason it is desired to print, onto a surface of the smart card, an imprint of the particular advertising slogon for which data is recorded on the smartcard.

It would be convenient to use the printing means of a postage meter to print the imprint of the advertising slogon on the smartcard. However the dimension of the card in a direction in which it is desired to feed the card to and past the print head is less than the spacing of the input rollers from the impression roller. As a consequence if the card is fed into and by the input rollers, the leading edge of the smartcard does not reach the impression roller before the trailing edge of the card leaves the input rollers. Therefore the card is fed by the input rollers and then lies in the space between the input rollers and the impression rollers and is not engaged by the rollers and is not fed past the print head. Accordingly it has not been possible to utilise the printing means of a postage meter to print on relatively short items such as smartcards.

SUMMARY OF THE INVENTION

According to one aspect of the invention a method of utilising a printer having first and second feeding means for feeding an item to receive an imprint past a print head, said first and second feeding means being operative to engage the item for the feeding thereof at first and second locations; said second location being spaced in a downstream direction from the first location by a distance of length greater than a dimension of the item in the direction of feeding thereof including the steps of providing a carrier for said item, said carrier being at least as long as said distance whereby the carrier and the item carried thereby are is fed by said second feeding means concurrently with feeding of the item by the first feeding means.

The printer may be a printer of a postage meter and the item may be a smartcard that is to receive an imprint of an advertising slogon defined by data stored in the smartcard.

According to a second aspect of the invention a carrier for an item to be fed by first and second feed means spaced apart in a direction of feed comprises a sheet like member having a recess therein to receive the item such that a surface of the item to receive an imprint is exposed, said carrier having a dimension in a direction of feed of the first and second means greater than the spacing of the first and second feed means.

BRIEF DESCRIPTION OF THE DRAWING

An embodiment of the invention will now be described by way of example with reference to the drawings in which.

DESCRIPTION OF THE PREFERRED EMBODIMENT

Figure 1:
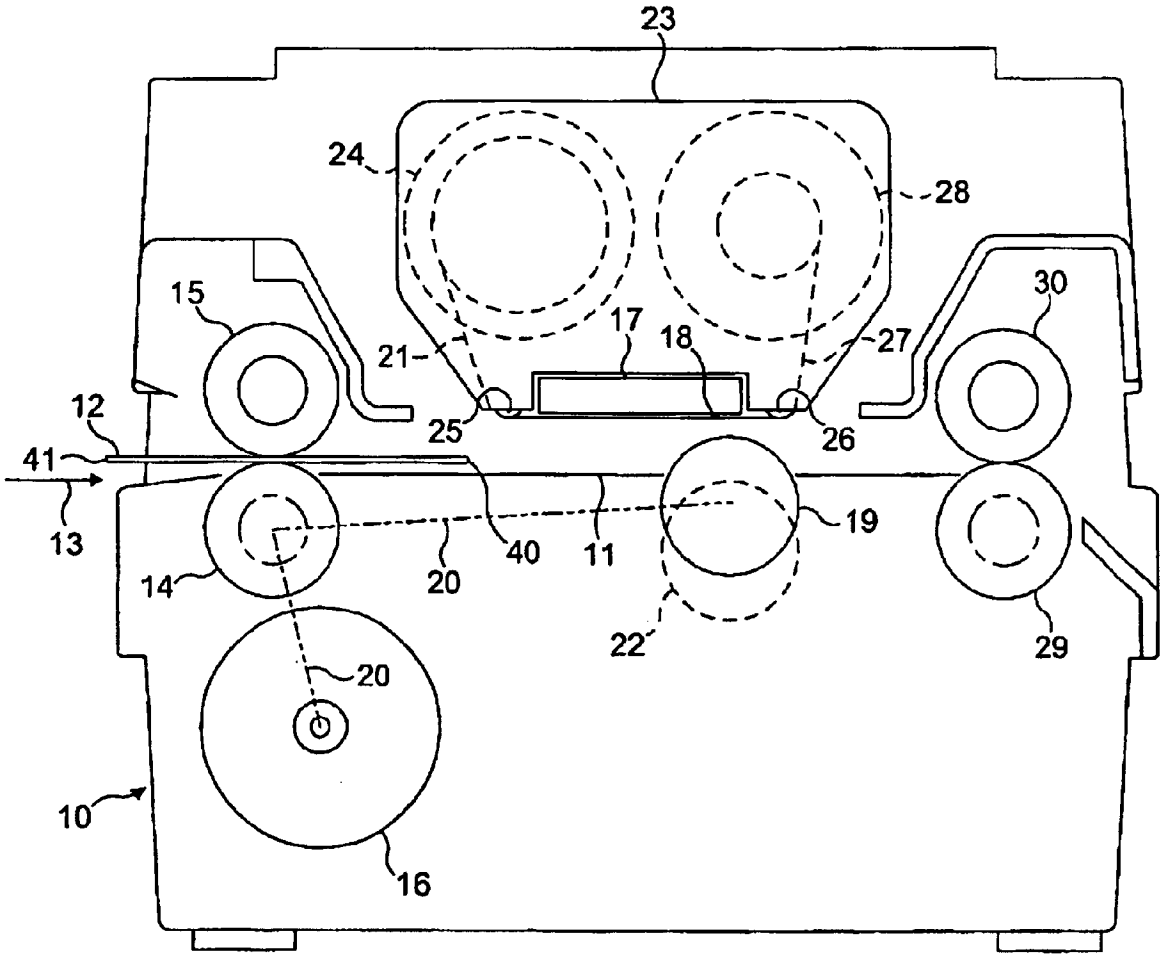
FIG. 1 illustrates thermal transfer printing means of a postage meter including means for feeding mail pieces to receive imprints.

Referring first to FIG. 1 of the drawings, a postage meter includes a housing and chassis 10 having a feed bed 11 extending horizontally therethrough along which mail pieces 12 required to receive an imprint can be fed, in the direction of arrow 13, to receive the imprint. A pair of input rollers 14, 15, of which roller 14 is driven by a motor 16 and roller 15 is an idler roller, are located at an upstream end of the feed bed to receive a leading edge of the mail piece 12 and then to feed the mail piece along the feed bed 11 toward a thermal print head 17. The input roller 14 extends through an aperture in the feed bed 11 such that the peripheral surface of the roller projects slightly above the feed bed so as to engage a mail piece to be fed. The idler roller 15 is resiliently mounted to press toward the driven roller 14 so that, when a mail piece 12 is entered into a nip between the rollers, the mail piece is frictionally engaged by the rollers and thereby is fed toward the print head 17. The mail piece continues to be fed by driven roller 14 and idler roller 15 and, in due course, the leading edge of the mail piece enters between an impression roller 19 and the print head.

The thermal print head is provided with a line of thermal printing elements (the location of the line being indicated by reference 18) extending transversely relative to the length of the feed bed 11. An impression roller 19, driven by a motor 16 is located in opposition to the line of thermal printing elements of the thermal print head 17 and projects through an aperture in the feed bed. Broken lines 20 indicate mechanical drive transmissions, for example pulleys and belts or trains of gear wheels, whereby drive is transmitted from the drive motor 16 to the input roller 14 and to the impression roller 19. The impression roller is resiliently mounted to press the mail piece being fed along the feed bed toward the row of thermal printing elements so that the mail piece is urged into ink transfer engagement with an ink layer of a thermal transfer ink ribbon 21 which passes along the print head and a rear surface of a substrate of the ink ribbon is urged into heat transfer engagement with the thermal printing elements of the print head. The engagement of the ink layer of the ribbon by the mail piece and the feeding of the mail piece by the impression roller 19 causes the ribbon to be drawn past the thermal printing elements at the same speed as and in synchronism with the feeding of the mail piece.

Printing is effected by selective thermal transfer of ink from the layer of ink of the ink ribbon 21 to the mail piece 12 that is to receive the imprint as a result of selective energisation of the thermal printing elements in a plurality of printing cycles while the mail piece is fed past the line of thermal printing elements in engagement with the ink ribbon. After passing the print head, the used ribbon is peeled from the mail piece leaving those areas of the ink layer that have been subjected to heating by energised ones of the printing elements adhered to the mail piece. In due course a trailing edge of the mail piece being fed by the input roller 14, 15 and the impression roller 19 will reach and pass through the nip between the rollers 14, 15 so that the rollers are then no longer effective to continue feeding the mail piece. However the mail piece will continue to be fed by the impression roller 19 until printing of the required imprint has been completed. When printing has been completed the impression roller is retracted into a position indicated by dotted line 22 and thereby releases the mail piece for ejection from the postage meter.

The thermal transfer ink ribbon is contained in a replaceable ribbon cassette 23. A supply of unused ink ribbon is provided wound on a supply spool 24 and is guided by a roller guide 25 to pass, out of the cassette, across the print head 17 past the thermal printing elements of the print head and after passing the thermal printing elements of the print head 17, the used ribbon is guided by a further roller guide 26 back into the cassette and the used ribbon 27 is wound onto a take-up spool 28.

A pair of ejection rollers 29, 30 are mounted at a downstream end of the feed bed, the roller 29 being driven by drive means (not shown) and the roller 30 being a resiliently mounted idler roller. In due course the leading edge of the mail piece being fed by the impression roller will be fed into a nip between the ejection rollers and after retraction of the impression roller the ejection rollers are driven at a higher speed to eject the mail piece from the postage meter.

It will be appreciated that in normal use of the postage meter the mail pieces 12 receive an imprint thereon of postage indicia providing evidence that accounting has been effected in respect of postage charges applied to the mail pieces and, optionally, advertising slogons. The mail pieces comprise envelopes containing inserts or postage labels for adhering to a package or parcel too large to be fed through the postage meter.

It will be appreciated that the mail piece to receive an imprint must be fed by the input rollers 14, 15 at least until a leading edge 40 of the mail piece has entered between the impression roller and the print head so that continued feeding of the mail piece can be effected by the rotation of the impression roller during printing of the imprint. Mail pieces generally have a length at least as long as the feed bed 11 and hence the leading edge 40 of such mail pieces reaches the impression roller and is fed thereby before a trailing edge 41 of the mail piece has reached and passed out from between the input rollers 14, 15.

The advertising slogon to be printed on mail pieces is defined by data that controls energisation of the printing elements of a digital print head such that in a series of printing cycles the complete advertising slogon is printed on the mail piece. This data to control operation of the printing elements is stored in a memory of the postage meter. However users of postage meters may desire to use different advertising slogons at different times. It is convenient to design such slogons remote from the postage meter and to be able to load a desired advertising slogon into the memory of the postage meter when desired. The remote design and supply, to users of postage meters, of advertising slogons will often be carried out by postage meter suppliers. A method of loading an advertising slogon into a slogon memory of a postage meter from a remote slogon library using telephone communication link is described in our U.S. Pat. No. 5,602,977 and pertinent disclosure therefrom is hereby incorporated in the present patent application. It is also desired to load advertising slogons into portable memory devices, for example so-called smartcards, whereby upon receipt of a smartcard in which data defining a required slogon is stored a user may place the smartcard in communication with the postage meter and download the slogon data from the memory of the smartcard into the memory of the postage meter.

Smartcards may be utilised for a number of different purposes and a user of a postage meter may have a number of smartcards loaded with different advertising slogons which may be used selectively at different times. It is required that an imprint be applied to the smartcard to enable the user to identify the advertising slogon stored in the smartcard. The slogon data defining the advertising slogon imprint is formatted for control of the printer of a postage meter and since a postage meter with a printer is readily available to a postage meter supplier who designs and supplies advertising slogans for users, it would be convenient to use the printer of a postage meter to print an imprint on the smartcard of the advertising slogon to enable the user to ascertain the slogon stored in the smartcard.

Figure 2:
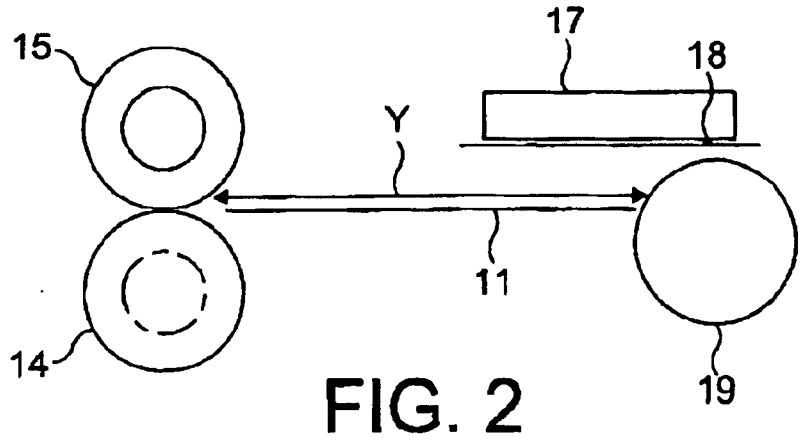
FIG. 2 is a part of the printing means illustrating means for feeding items to be printed.

However smartcards have dimensions significantly smaller than the dimensions of common mail pieces usually fed through the printer of postage meters. If a relatively short item having a length y less than a length Y (see FIG. 2) between the nips of the input roller 14, 15 and of the impression roller with the print head is entered into the nip between the input rollers, the trailing end of the item will reach and pass from the nip between the input rollers before the leading edge of the item has reached and has been drivingly engaged in the nip between the impression roller and the print head. As a result, after being fed by the input rollers, such an item will remain on the feed bed between the input rollers and the impression roller and hence will not be fed past the thermal printing elements of the print head and will not receive an imprint. Accordingly it has not been possible to utilise the postage meter printer to print on items as small as smartcards.

As discussed hereinbefore it is desirable to be able to utilise a postage meter with a thermal transfer printer because such apparatus is readily available. Furthermore it will be appreciated that the input rollers must be spaced from the impression roller in order to accommodate not only the print head but also the cassette for the ink ribbon. Accordingly it will be understood that the printer of a postage meter cannot easily be modified to apply imprints on relative short items such as smartcards.

Figure 3:
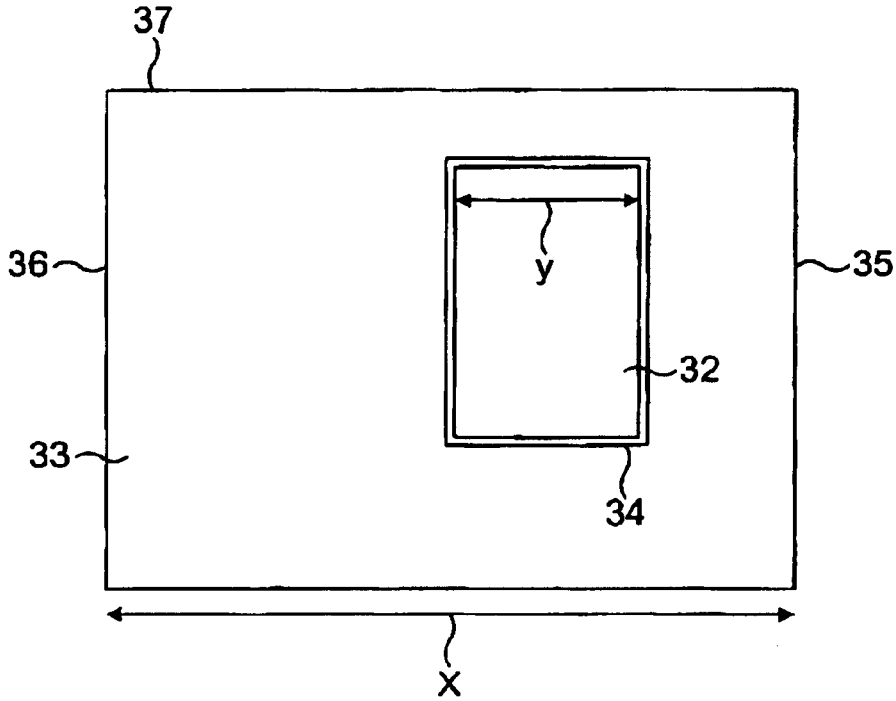
FIG. 3 illustrates a smartcard in combination with a carrier therefor.

In order to permit use of the postage meter printer to print on a smartcard 32 having a length y, a carrier is provided for the smarteard as shown in FIG. 3. The carrier comprises a thin sheet 33 having a recess 34 therein. The recess 34 has dimensions to receive the smartcard 32 such that an exposed surface of the smartcard that is to receive an imprint is approximately level with a surface of the sheet. For purposes of illustration, in FIG. 3 the smartcard is shown as being smaller than the recess 34. However it will be appreciated that the recess is of such dimensions that the smartcard is received therein with a snug fit so that the smartcard is so held in the recess that the smartcard is not able to move to any significant extent relative to the carrier. The sheet has a dimension X sufficiently large and greater than Y that when the carrier is entered into the nip of the input rollers 14, 15 with the edge 35 of the carrier leading, the edge 35 will reach and be engaged by the impression roller for feeding the smartcard, carried by the carrier, in printing engagement with the ink ribbon 21 past the print head 17 before a trailing edge 36 of the carrier leaves the nip between the input rollers. Accordingly the carrier continues to be fed by the input rollers until after the carrier is engaged by the impression roller and hence after being entered into the nip between the input rollers, the smartcard carried in the carrier is positively driven by the pair of input rollers 14, 15, the pair of input rollers and the impression roller 19 or the impression roller until printing of the imprint of the slogon is completed.

The recess 34 is located a predetermined distance from the leading edge 35 so that after sensing of the leading edge 35 of the carrier by sensing means (not shown) of the postage meter, commencement of printing is timed such that the slogon is printed across the exposed surface of the smartcard. Postage meters are controlled so as to print a postage indicium at a predetermined location relative to a right edge and an upper edge of a mail piece and to print an advertising slogon at the left hand side of and adjacent to the postage indicium. Accordingly if desired the carrier may be constructed to locate the smartcard relative to the right hand edge 35 and an upper edge 37 of the carrier in a location corresponding to the location in which an advertising slogon would be printed on a mail piece.

While the carrier is described hereinbefore as being a sheet having recess therein, it may be formed as a two layer structure, a first layer being continuous and the second having an aperture of size corresponding to the required recess and the second layer overlying and being bonded to the first layer. It will be understood that the carrier has a thickness similar to mail pieces so that it may be fed between the input rollers 14, 15, between the impression roller 19 and the print head 17 and between the ejection rollers 29, 30.

Hereinbefore, the item to which the imprint is to be applied has been described as a smartcard. It is to be understood that other items, for example memory cards of similar dimensions to smartcards and items which do not include electronic circuits may also be printed on in the same manner using a carrier therefor. Items having relatively small dimensions are difficult to handle and to maintain in alignment in a printer and the provision of a carrier of larger dimensions facilitates handling of the item and printing thereon.

It will be appreciated that the surface of the smartcard or memory card on which the imprint is to be applied is a surface of a synthetic plastics substance instead of paper forming a mail piece. Consequently the conditions required for producing a required quality of imprint may be different from those required for producing an imprint on mail pieces. Therefore it may be necessary to use a thermal transfer ink ribbon having a characteristic different from ribbons used for printing on mail pieces and it may be necessary to increase the power applied to the thermal printing elements of the print head as compared with the power required to print on mail pieces. It has been found that utilizing a thermal transfer printing process, a strong bond is obtained between the ink and the surface of the smartcard and hence the imprint on the smartcard is not easily damaged or worn away. However if desired other forms of printing, for example inkjet, may be used.

As described hereinbefore, it is desired to make use of the printing means in commercially available postage meters to print on the items such as smartcards. Recently developed postage meters use ink jet print heads and in some of these postage meters the mail pieces are located manually and are not fed through the postage meter. The mail piece is located in a required position in engagement with guides and the print head is traversed across the mail piece. If desired postage meters constructed to operate and be used in this manner may be used to print on relatively small items such as smartcards by utilizing a carrier to locate the item in a required location relative to the guides to ensure printing of the advertising slogon in the required position. In addition to advertising slogons, the smartcards or memory cards may be used to input other data into postage meters and the printing means may be utilized to print information indicating the data stored in the card.

I claim:

1. A method of using a postage meter to print on a memory card storing an advertising slogan, wherein the postage meter includes a memory for storing the advertising slogan and a printer having a print head and first and second feeding means for feeding a memory card mounted on a carrier past the print head to receive an imprint of the advertising slogan, the first and second feeding means being operative to engage the carrier at first and second spaced locations to feed the same in a feeding direction, with the second location being spaced in a downstream direction from the first location by a distance greater than a dimension of the memory card in the feeding direction, the method comprising the steps of:

downloading advertising slogan data from the memory card into the memory of the postage meter;

providing a carrier for the memory card, the carrier having a length at least equal to the distance between the first and second locations;

mounting the memory card to the carrier;

feeding the memory card while mounted in the carrier to and past the print head by utilizing the first and second feeding means to concurrently feed the carrier, whereby the memory card is fed by the first feeding means at least until the carrier is fed by the second feeding means; and printing an imprint of the advertising slogan from the advertising slogan data in the memory of the postage meter on the memory card.

2. The method as claimed in claim 1, wherein the carrier comprises a sheet member including a recess at a surface thereof to receive the memory card such that a face of the memory card to receive the imprint of the advertising slogan is exposed.

3. The method as claimed in claim 2, wherein the recess has a depth such that the face of the memory card where received in the recess is approximately level with the surface of the carrier.

4. The method as claimed in claim 2, wherein the carrier comprises a first sheet element and a second sheet element bonded in overlying relation to the first sheet element, and the second sheet element includes an aperture therein forming the recess to receive the memory card.

5. The method as claimed in claim 1, wherein the memory card is a smartcard.

* * * * *